US008250695B2

(12) United States Patent
Karuppiah et al.

(10) Patent No.: US 8,250,695 B2
(45) Date of Patent: Aug. 28, 2012

(54) ROLLER ASSEMBLY FOR A BRUSH CLEANING DEVICE IN A CLEANING MODULE

(75) Inventors: Lakshmanan Karuppiah, San Jose, CA (US); Dan Zhang, Fremont, CA (US); Simon Yavelberg, Cupertino, CA (US); Jim K. Atkinson, Los Gatos, CA (US); Hung Chih Chen, Sunnyvale, CA (US); Noel Manto, Walnut Creek, CA (US); Jonathan Domin, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 493 days.

(21) Appl. No.: 12/573,500

(22) Filed: Oct. 5, 2009

(65) Prior Publication Data

US 2011/0079245 A1 Apr. 7, 2011

(51) Int. Cl.
*A47L 25/00* (2006.01)

(52) U.S. Cl. ..... 15/77; 15/88.2

(58) Field of Classification Search ..... 134/6, 33; 15/77, 88.2

See application file for complete search history.

(56) References Cited

U.S. PATENT DOCUMENTS

| | | | | |
|---|---|---|---|---|
| 3,964,957 | A * | 6/1976 | Walsh | 156/345.23 |
| 5,862,560 | A * | 1/1999 | Jensen et al. | 15/77 |
| 6,328,640 | B1 * | 12/2001 | Jones et al. | 451/194 |
| 6,918,864 | B1 | 7/2005 | Brown et al. | |
| 7,377,002 | B2 | 5/2008 | Yudovsky et al. | |
| 2008/0223402 | A1 | 9/2008 | Haneda et al. | |

FOREIGN PATENT DOCUMENTS

| | | | |
|---|---|---|---|
| JP | 2007-509749 | A | 4/2007 |
| KR | 10-2005-0000570 | A | 1/2005 |
| KR | 10-2007-0119823 | A | 12/2007 |

OTHER PUBLICATIONS

International Search Report for International Application No. PCT/US2010/045709 mailed Mar. 25, 2011.

* cited by examiner

*Primary Examiner* — Saeed T Chaudhry
(74) *Attorney, Agent, or Firm* — Patterson & Sheridan, LLP

(57) ABSTRACT

Embodiments described herein relate to an apparatus and method for a roller assembly that may be utilized in a brush cleaning module. In one embodiment, a roller assembly is described. The roller assembly includes an annular groove having at least two substantially parallel opposing sidewalls adapted to contact the major surfaces of a substrate along a periphery of the substrate, each of the opposing sidewalls comprising a compressible material having a pre-compressed dimension that is less than a thickness of the periphery of the substrate.

12 Claims, 5 Drawing Sheets

ROLLER ASSEMBLY FOR A BRUSH CLEANING DEVICE IN A CLEANING MODULE

BACKGROUND OF THE INVENTION

1. Field of the Invention

Embodiments of the invention relate to electronic device manufacturing. In particular, embodiments relate to a cleaning module, such as a scrubber box, for cleaning thin discs such as semiconductor substrates, wafers, compact discs, glass substrates and the like.

2. Description of the Related Art

Cleaning modules, sometimes referred to as scrubbers, scrubber boxes or brush boxes, are often utilized to clean semiconductor substrates at one or more stages of an electronic device manufacturing process. For example, a scrubber box may be utilized to clean a substrate after chemical mechanical polishing (CMP) of the substrate. Known scrubber boxes typically use a one or more rotating brushes that are urged against a rotating substrate to thereby clean the substrate. The substrate is typically supported by and/or caused to rotate using one or more roller assemblies.

As the demand for integrated circuits continue to rise, chip manufactures have demanded semiconductor process tooling have increased throughput and more robust processing equipment. To meet such demands, apparatus and methods are being developed to better control the substrate during cleaning to maximize throughput, increase the service life of tool components, and decrease the cost of ownership.

While a number of scrubber boxes exist in the art, a need remains for a roller assembly to better support and/or control the rotation of the substrate during cleaning, as well as extend the lifetime of the roller assembly to minimize or extend replacement frequency.

SUMMARY OF THE INVENTION

Embodiments generally relate to a method and apparatus for a washer assembly utilized in a drive roller assembly or an idler roller assembly in a cleaning module. In one embodiment, a roller assembly is described. The roller assembly includes a first washer, and a second washer, the first washer and the second washer having an annular groove formed at least partially in a surface of the first washer or the second washer, the annular groove including at least two substantially parallel opposing sidewalls adapted to contact the major surfaces of a substrate along a periphery of the substrate, each of the opposing sidewalls comprising a compressible material having a pre-compressed dimension that is less than a thickness of the periphery of the substrate.

In another embodiment, a roller assembly is described. The roller assembly includes a washer assembly sandwiched between a hub and a flange, the washer assembly comprising a first washer, and a second washer contacting a surface of the first washer, the first washer and second washer having sidewalls defining an annular groove adapted to receive a periphery of a substrate, the annular groove having a width that is less than a thickness of the periphery of the substrate.

In another embodiment, a method for cleaning a substrate is described. The method includes transferring a substrate into a cleaning tank, guiding the substrate into a groove disposed on a roller disposed in the cleaning tank, pressing a peripheral edge of the substrate into the groove so that the major surfaces of the substrate are gripped by opposing sidewalls of the groove, and rotating one of the substrate or the roller relative to the other while urging a scrubber brush against the major surfaces of the substrate.

BRIEF DESCRIPTION OF THE DRAWINGS

So that the manner in which the above-recited features of the present invention can be understood in detail, a more particular description of the embodiments, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments described herein generally provide an apparatus and method for a roller assembly for a brush-type cleaning system that may be utilized in a scrubber box. The scrubber box utilizes a brush or cylindrical roller that is selectively urged against a substrate. The substrate may be caused to rotate relative to the brush to effect cleaning of the substrate. In one embodiment, the cleaning process is performed after a chemical mechanical polishing process is performed on a substrate. The roller assembly may be used to support the substrate, as well as control the rotation of the substrate. The roller assembly may also be interfaced with a speed monitoring system adapted to monitor the rotation of the substrate in the cleaning system.

Embodiments described herein are exemplarily described with reference to a roller assembly utilized as an idler roller but may be utilized for drive rollers and for other devices that may be utilized for rotational support. Embodiments of cleaning modules that may be adapted to benefit from the invention include a cleaner module that is part of a SYCAMORE™ polishing system and a DESICA® cleaner, both available from Applied Materials, Inc., located in Santa Clara, Calif. Embodiments described herein may also be utilized on cleaner modules and polishing systems available from other manufacturers.

Figure 1:
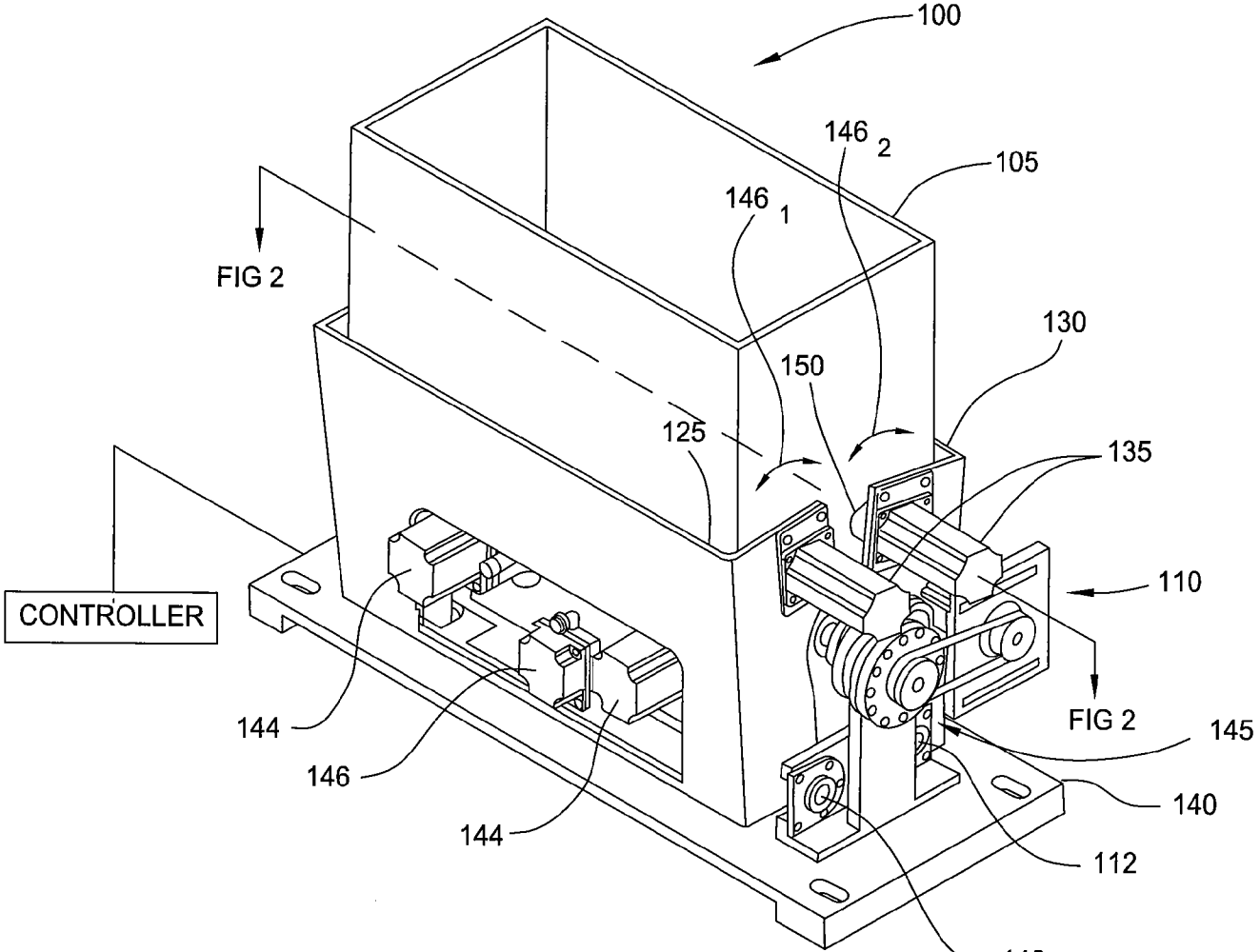
FIG. 1 is an isometric view of a scrubber box.
Figure 2:
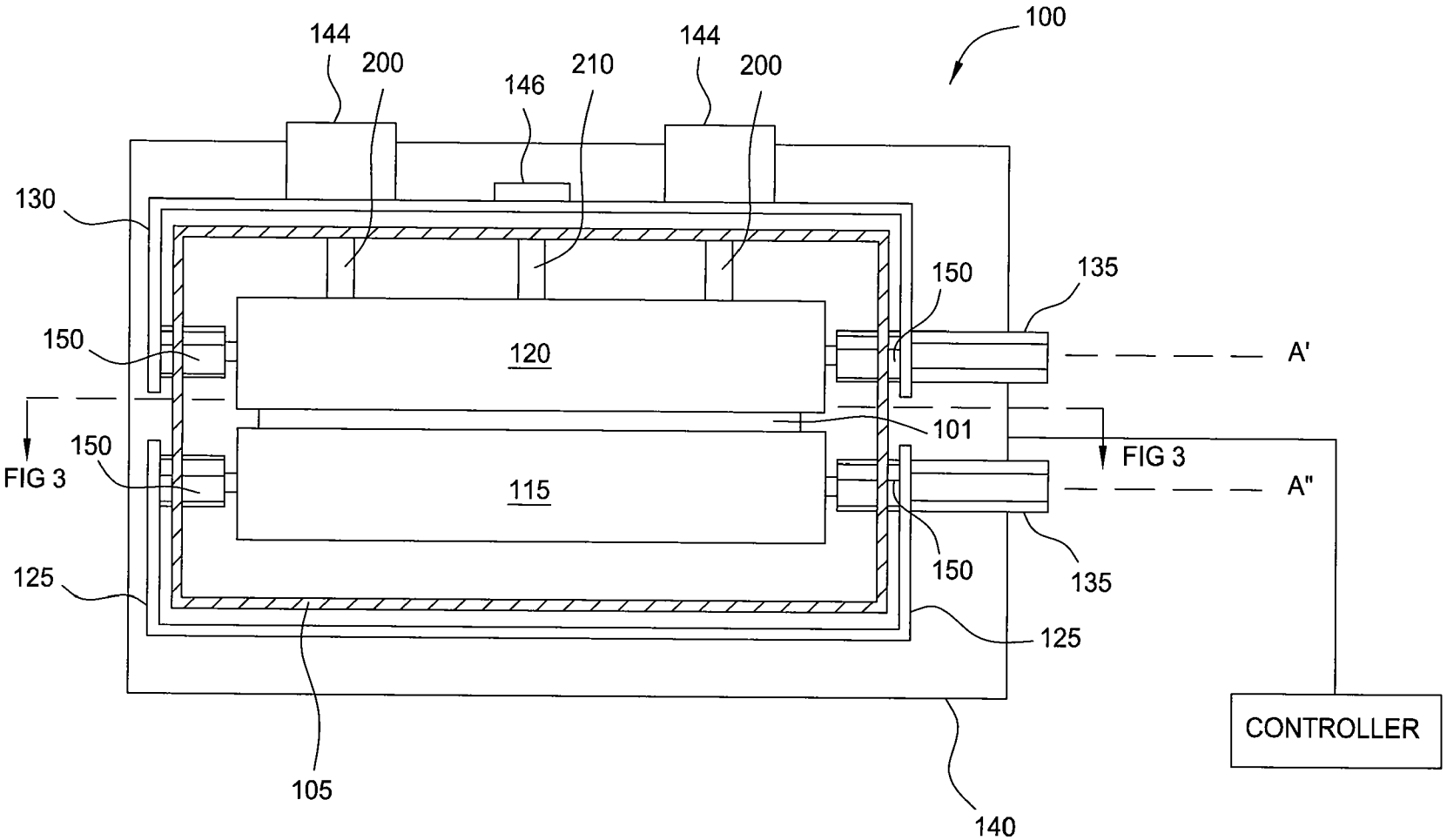
FIG. 2 is a top cross-sectional view of the scrubber box of FIG. 1.

FIG. 1 is an isometric view of a scrubber box 100 that may be utilized in a cleaner module as described above. FIG. 2 is a top view of the scrubber box 100 of FIG. 1. The scrubber box 100 includes a tank 105 that is at least partially encased in a first support 125 and a second support 130. Each of the supports 125, 130 are coupled to a linkage 110 that is external to (i.e., outside of) the tank 105 of the scrubber box 100. Each of the supports 125, 130 are adapted to support an actuator 135. Each actuator 135 is coupled to a scrubber brush 115, 120 (shown in FIG. 2) located inside the tank 105. The actuators 135 provide rotational movement of the respective scrubber brushes about axis A. Each of the actuators 135 may be drive motors, such as direct drive servo motors adapted to rotate the respective scrubber brushes 115, 120 about axes A' and A". Each of the actuators 135 are coupled to a controller adapted to control the rotational speed of the scrubber brushes 115, 120.

The linkage 110 is coupled to each of the supports 125, 130, a base 140, and an actuator 145. The linkage 110 is utilized for convenient and accurate actuation/movement of the scrubber brushes 115, 120 located inside the tank 105 relative to the major surfaces of a substrate 101 (shown in FIG. 2). Additionally, clearance holes (not shown) may be formed in the tank 105 to achieve rotational coupling between the brushes 115, 120, actuators 135 and the supports 125, 130. A compliant coupling element 150, such as a seal, a flexible washer, or a bellows, may be disposed around each hole and mounted between the tank 105 and the supports 125, 130. Such an arrangement (1) permits relative motion of the scrubber brushes 115, 120 relative to the walls of the tank 105; (2) protects the substrate 101 against particulate contamination that might otherwise pass into the interior of the tank 105 through the holes in the tank walls; and/or (3) permits a fluid level in the tank 105 to reach or exceed the level of the holes while preventing fluid from draining therethrough. The actuator 145 is coupled to the controller to control the movement of the linkage 110.

Each of the first and second supports 125, 130 are coupled to the base 140 by a pivot point 112 to which the first and second supports 125, 130 may be adapted to pivot (upward and inward toward one another, and/or downward and outward away from one another). In operation, the first and second supports 125, 130 may be moved simultaneously through respective arcs $\mathbf{146}_1$, $\mathbf{146}_2$, as shown in FIG. 1, relative to the base 140. Such movement may cause the first and second scrubber brushes 115, 120 to close against the substrate 101 as shown in FIG. 2, or to cause a gap between the first and second scrubber brushes 115, 120 and the substrate 101 (not shown) to allow insertion and/or removal of the substrate 101 from the scrubber box 100.

The scrubber box 100 also includes one or more drive motors 144 and a rotational device 146. Each of the drive motors 144 and rotational device 146 include shafts 200, 210, respectively that are coupled to a roller assembly (not shown) configured to support and/or engage the substrate 101. Each of the drive motors 144 may be direct drive servo motors and the rotational device 146 may be a bearing. In some embodiments, the rotational device 146 may also include a sensor system for monitoring the rotation of the supported substrate. Each of the drive motors 144 are coupled to the controller to control the rotational speed of the substrate 101. In embodiments where the rotational device 146 includes a sensor system, the rotational device 146 is also in communication with the controller to provide a metric of rotational speed of the substrate 101 to the controller. In this embodiment, any rotational overspeed or underspeed sensed by the rotational device 146 may trigger an alarm.

Figure 3B:
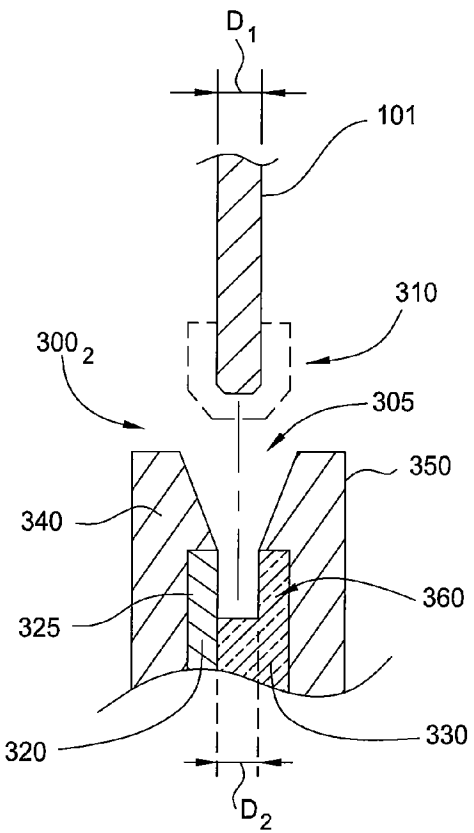
FIG. 3B is a partial cross-sectional view of one embodiment of a roller assembly.
Figure 3A:
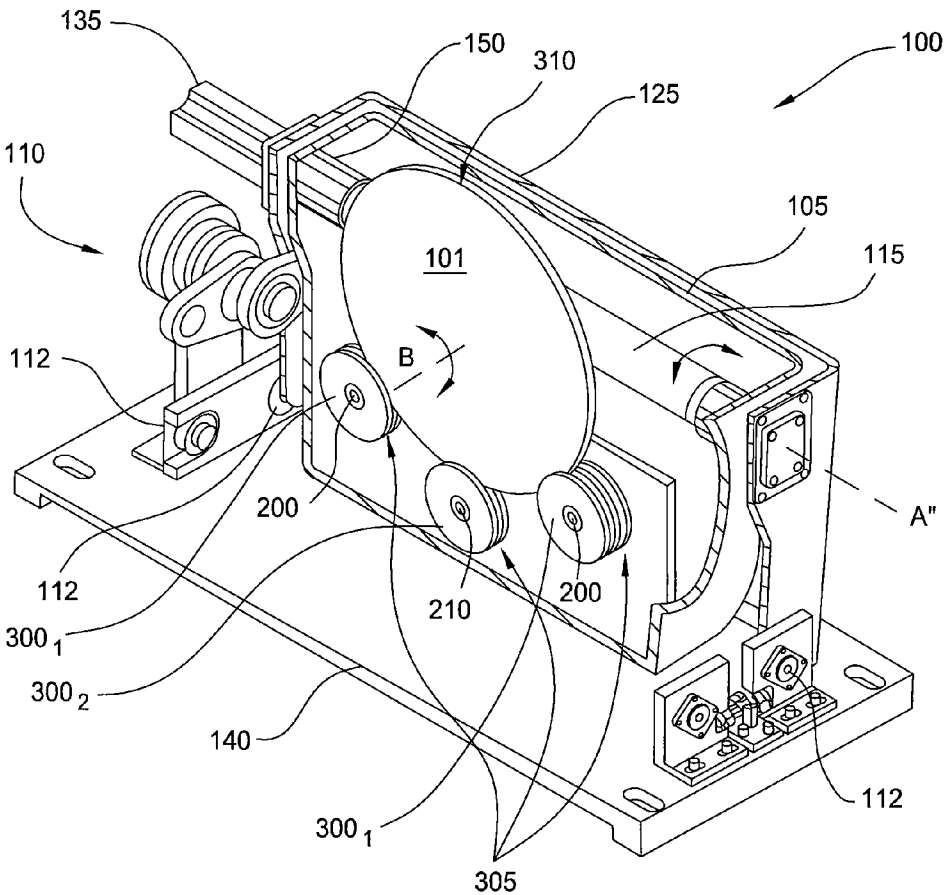
FIG. 3A is a partial isometric cut-away view of the scrubber box of FIG. 2, rotated 180 degrees.

FIG. 3A is an isometric cut-away view of the scrubber box of FIG. 2, rotated 180 degrees, showing internal components of the scrubber box 100. In FIG. 3A, a portion of the tank 105 is cut-away to show a substrate 101 supported and/or engaged by one or more roller assemblies $\mathbf{300}_1$, $\mathbf{300}_2$, which are coupled to the drive motors 144 (shown in FIG. 1) and the rotational device 146 (shown in FIG. 1), respectively. In one embodiment, the roller assemblies $\mathbf{300}_1$ are configured as drive rollers and the roller assembly $\mathbf{300}_2$ is configured as an idler roller. Each of the roller assemblies $\mathbf{300}_1$, $\mathbf{300}_2$ include a grooved portion 305 adapted to receive a periphery 310 of the substrate 101. The periphery 310 includes a minor surface or edge of the substrate 101 as well as a portion of the major surfaces or sides of the substrate 101. In one embodiment, the periphery 310 includes at least a portion of the edge exclusion zone of the substrate 101.

Each of the roller assemblies $\mathbf{300}_1$, $\mathbf{300}_2$ are adapted to support the substrate 101 and facilitate rotation of the substrate 101 about axis B. One or more of the roller assemblies $\mathbf{300}_1$, $\mathbf{300}_2$ may additionally be adapted to engage or grip the periphery 310 of the substrate 101 to prevent slippage between the grooved portion 305 and the substrate 101 during rotation of the substrate 101.

FIG. 3B is a partial cross-sectional view of one embodiment of a roller assembly $\mathbf{300}_2$ engaging the periphery 310 of the substrate 101. In this embodiment, the roller assembly $\mathbf{300}_2$ includes a washer assembly 325, which includes a first washer 320 and a second washer 330. The washer assembly 325 is sandwiched between rotational structural elements, such as a flange 340 and a hub 350.

In one embodiment, the washer assembly 325 is made from a material that is at least partially flexible or deformable such that the periphery 310 may be inserted therein. In one embodiment, one or both of the first washer 320 and second washer 330 is made from an elastic, compressible or flexible material at room temperature, such as polyurethane. In one aspect, the polyurethane material includes a hardness between about 55 Shore A to about 65 Shore A, for example about 60 Shore A. In one embodiment, the substrate 101 includes a thickness depicted as dimension $D_1$ and the washer assembly 325 includes a gripping gap 360 having an uncompressed width dimension (shown as dimension $D_2$) that is slightly less than the dimension $D_1$. Upon insertion of the substrate 101, one or both of a surface of the washers 320, 330 are compressed to allow the periphery 310 of the substrate 101 to be received in the gap 360. The compressive force of the elastic material in the gap 360 holds the substrate 101 snugly in the washer assembly 325. In one embodiment, the dimension $D_1$ of the substrate 101 is about 0.030 inches while the pre-compressed dimension $D_2$ of the gap 360 is about 0.023 inches to about 0.029 inches, such as about 0.027 inches.

In operation, with reference to FIGS. 1-3B, the supports 125, 130 are moved outward and away from each other to provide a gap between the first and second scrubber brushes 115, 120. The substrate 101 is transferred into the tank 105 between the first and second scrubber brushes 115, 120 by a robot or end effector (not shown). The robot guides the periphery 310 of the substrate 101 into each grooved portion 305 of the roller assemblies $\mathbf{300}_1$, $\mathbf{300}_2$. In one embodiment, the robot or end effector urges the substrate 101 into each grooved portion 305 such that the periphery 310 of the substrate 101 is inserted into each grooved portion 305 of the roller assemblies $\mathbf{300}_1$, $\mathbf{300}_2$ and seated in the gap 360.

As the substrate 101 is seated in the roller assemblies $\mathbf{300}_1$, $\mathbf{300}_2$, the supports 125, 130 are moved inward and toward each other and the first and second scrubber brushes 115, 120 contact the major surfaces of the substrate 101. The substrate 101 is caused to rotate about axis B by action of the roller assemblies $\mathbf{300}_1$ and the drive motors 144. The first and second scrubber brushes 115, 120 are caused to rotate about axes A' and A" relative to the rotating substrate 101 to perform a cleaning process. After the substrate 101 has been cleaned by the first and second scrubber brushes 115, 120, the rotation of the first and second scrubber brushes 115, 120 and the substrate 101 may be stopped. The supports 125, 130 are again moved outward and away from each other to provide a gap between the first and second scrubber brushes 115, 120. The substrate 101 may be released from the roller assemblies $\mathbf{300}_1$, $\mathbf{300}_2$ and removed from the tank 105 by the robot or end effector and another substrate may be transferred into the tank 105 for cleaning.

Figure 4:
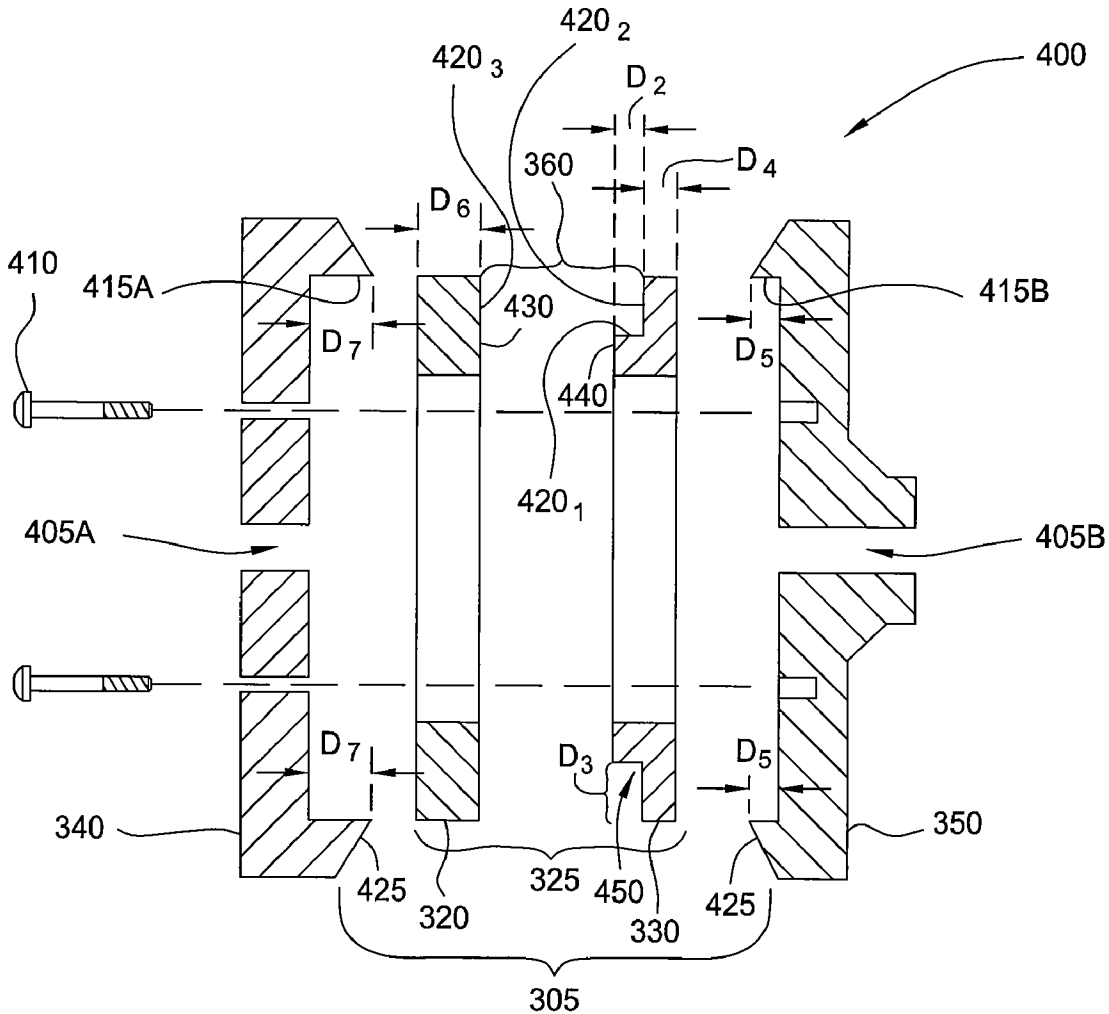
FIG. 4 is an exploded cross-sectional view of one embodiment of a roller assembly.

FIG. 4 is an exploded view of one embodiment of a roller assembly 400 that may be utilized as one or all of the roller assemblies $\mathbf{300}_1$, $\mathbf{300}_2$ described in FIGS. 3A and 3B. The roller assembly 400 includes a washer assembly 325 having a two-piece construction that includes a first washer 320 and a second washer 330 that are generally annular disks. In operation, the first washer 320 and second washer 330 are secured between a flange 340 and a hub 350 by one or more fasteners 410. The one or more fasteners 410 may be removable fasteners, such as screws, bolts or other removable fasteners that allow easy assembly and disassembly of the washer assembly 325. Each of the flange 340 and the hub 350 include a bore 405A, 405B that is configured to receive a shaft (not shown) from the drive motors 144 and/or the rotational device 146 (both shown in FIG. 1). In this manner, the washer assembly 325 may be easily inspected and replaced, if necessary.

The first washer 320 and second washer 330 form the gap 360 that in one embodiment is provided by a combination of a bottom $\mathbf{420}_1$ and a sidewall $\mathbf{420}_2$ of the second washer 330, and an opposing sidewall $\mathbf{420}_3$ of the first washer 320 that is substantially parallel to the sidewall $\mathbf{420}_2$ of the second washer 330. In one embodiment, the bottom $\mathbf{420}_1$ includes a dimension $D_2$, which may be a width dimension or a length dimension of the gap 360 relative to a longitudinal axis of the washer assembly 325. In one aspect, the dimension $D_2$ is about 0.023 inches to about 0.029 inches, for example, about 0.027 inches. In the embodiment shown, the bottom $\mathbf{420}_1$ is formed entirely in the second washer 330 although in other embodiments (not shown), the bottom $\mathbf{420}_1$ may be formed at least partially in both of the first washer 320 and second washer 330. The bottom $\mathbf{420}_1$ is formed to a depth dimension $D_3$ of about 0.050 inches to about 0.15 inches As the thickness of the periphery 310 of the substrate 101 (not shown in this Figure) is about 0.030 inches, the sidewalls $\mathbf{420}_2$, $\mathbf{420}_3$ enable a press-fit of the substrate 101 therein and grip the periphery 310 of the substrate 101.

In one embodiment, the first washer 320 includes a substantially planar first sidewall 430 that is adapted to contact a planar face 440 of the second washer 330 when assembled. The planar face 440 may be in the same planar orientation and include the same surface finish as the sidewall $\mathbf{420}_3$. The face 440 of the second washer 330 includes a stepped portion 450 that forms the bottom $\mathbf{420}_1$ of the second washer 330 and transitions to a second sidewall $\mathbf{420}_2$ that is substantially parallel with the first sidewall 430. In one embodiment, the periphery 310 of the substrate 101 is contacted and gripped between the first sidewall 430 and the second sidewall $\mathbf{420}_2$.

The flange 340 and the hub 350 include radial stepped portions 415A, 415B, respectively, that are adapted to receive the first washer 320 and second washer 330. The stepped portion 415B includes a dimension $D_5$ that is substantially equal to or slightly less than a dimension $D_4$ of the second washer 330. Likewise, the stepped portion 415A includes a dimension $D_7$ that is substantially equal to or slightly less than a dimension $D_6$ of the first washer 320. Each of the flange 340 and the hub 350 also include a sloped surface 425 adapted to guide a substrate (not shown) into the gap 360.

Figure 5A:
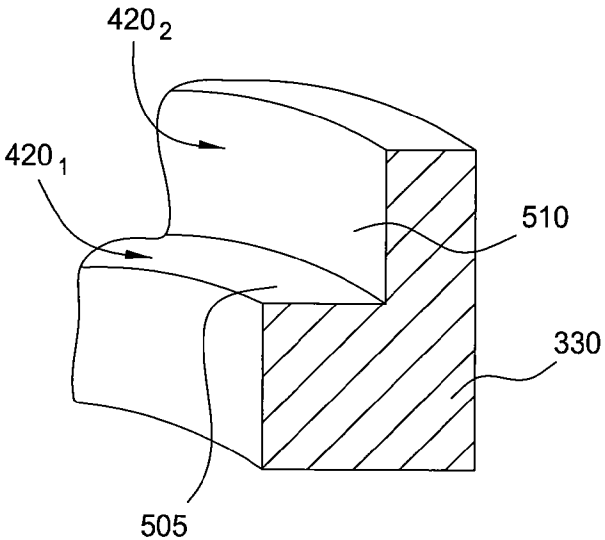
FIG. 5A is an enlarged, partial sectional view of one embodiment of a washer utilized in the roller assembly of FIG. 4.

FIG. 5A is an enlarged, partial sectional view of one embodiment of a second washer 330. Each of the bottom $\mathbf{420}_1$ and the sidewall $\mathbf{420}_2$ of the second washer 330 include a surface 505 and 510, respectively. In one embodiment, the surface 510 include a surface finish that is utilized to enhance friction between a substrate (not shown) and the surface 510. In one aspect, the surface 510 includes an average surface roughness (Ra) of about 2 microns to about 4 microns. Increasing the roughness of the sidewall $\mathbf{420}_2$ allows for better and more consistent contact with the substrate. The consistent contact provides enhanced rotation of the substrate when the washer assembly 325 is utilized with the roller assemblies $\mathbf{300}_1$ to rotate the substrate. The consistent contact also prevents or decreases slippage of the substrate. This is especially important when the washer assembly 325 is utilized as an idler roller that may facilitate a metric of rotational speed of the substrate. Thus, the rotational speed imparted to the substrate by the roller assemblies $\mathbf{300}_1$, $\mathbf{300}_2$ is accurately controlled and/or monitored. The enhanced rotation of the substrate prevents or minimizes the frequency of low speed alarms (and/or high speed alarms) which causes downtime of the tool.

Figure 5C:
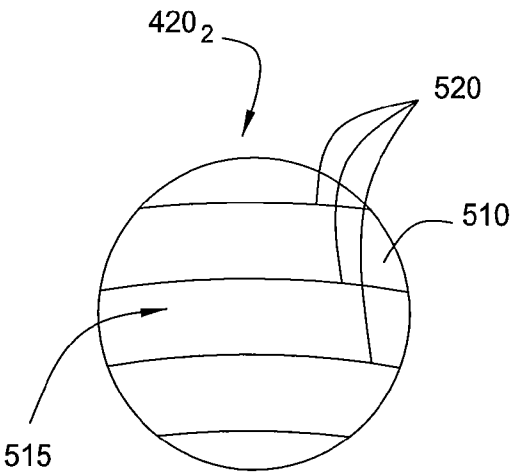
FIG. 5C is an enlarged view of a portion of the sidewall surface of the washer of FIG. 5A showing another embodiment of a surface finish.
Figure 5B:
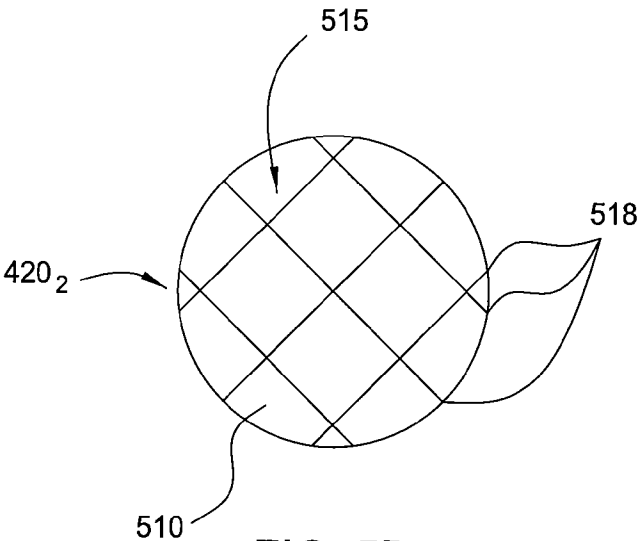
FIG. 5B is an enlarged view of a portion of the sidewall surface of the washer of FIG. 5A showing one embodiment of a surface finish.

FIG. 5B is an enlarged view of a portion of the surface 510 of the second washer 330 of FIG. 5A showing one embodiment of a surface finish that may be utilized on the sidewall $\mathbf{420}_2$ of the second washer 330. In this embodiment, the surface 510 includes a surface finish which includes a textured pattern 515. In one embodiment, the pattern 515 includes a plurality of linear elements 518 which may be raised ribs or sub-surface grooves formed in or on the surface 510. In one embodiment, the pattern 515 includes hatching or knurling formed in a grid or grid-like pattern.

FIG. 5C is an enlarged view of a portion of the surface 510 of the second washer 330 of FIG. 5A showing another embodiment of a surface finish that may be utilized on the sidewall $\mathbf{420}_2$ of the second washer 330. In this embodiment, the surface 510 includes a surface finish which includes another embodiment of a textured pattern 515. In this embodiment, the pattern 515 includes a plurality of circular structures 520. Each of the circular structures 520 may be raised ribs or sub-surface grooves formed in or on the surface 510. Each of the circular structures 520 may be circular in shape or form segments of a circle. While not shown, the sidewall $\mathbf{420}_3$ of the first washer 320 includes a surface having one or a combination of surface finishes as described above in reference to the second washer 330 described in FIGS. 5A-5C. Additionally, while the patterns 515 are shown on specific surfaces of the washer assembly 325, the patterns 515 may be used interchangeably on either of the surfaces 505 and 510.

Due to the design of the washer assembly 325, the size of the gap 360 and surface texturing and/or roughness parameters of the surfaces on the bottom $\mathbf{420}_1$ and the sidewalls $\mathbf{420}_2$, $\mathbf{420}_3$ may be formed according to desired specifications. Such precise fabrication in gap size and/or variations of surface finishes and/or textures were not possible in the conventional washer design. The conventional washer designs were typically fabricated using a turning process utilizing lathe adapted to form the gap 360. However, the turning tool would frequently break and/or surface finishes on the bottom $\mathbf{420}_1$ and the sidewalls $\mathbf{420}_2$, $\mathbf{420}_3$ could not be controlled.

The two-piece construction of the washer assembly 325 allows the first washer 320 and second washer 330 to be manufactured by many alternative methods. For example, the first washer 320 and second washer 330 of the washer assembly 325 may be manufactured by different machining techniques, such as turning, milling, and laser machining, among others. The washer assembly 325 may also be manufactured using a molding process. Fabrication of the washer assembly 325 in this manner allows greater flexibility in the construction of the washer assembly 325 than what was available or possible in the conventional design. For example, alternative and consistent surface finishes on each of the first washer 320 and second washer 330 are possible. The consistent surface finish of the washer assembly 325 is believed to maximize the friction between the substrate and the washer assembly 325 as well as increase the lifetime of the washer assembly 325. Additionally, surface finishes may be inspected utilizing non-destructive inspection methods as opposed to destructive inspection methods that were typically required for the conventional designs due to the inability to access the inner surfaces for inspection. Thus, the design of the washer assembly 325 decreases fabrication costs. Moreover, the increased friction between the substrate and the washer assembly 325 will decrease the number of low speed alarms, which decreases downtime and increases throughput.

The design of the washer assembly 325 has also shown a marked increase in lifetime as compared to the conventional washer designs. The increased lifetime decreases replacement frequency and downtime. For example, the replacement frequency of the washer assembly 325 provides a coincidental replacement of other parts in the scrubber box 100, which allows replacement of the washer assembly 325 to be scheduled with the replacement of other parts in the scrubber box 100. For example, the lifetime of the conventional washer design was 10,000 substrates to 16,000 substrates, dependent on chemistry and/or pressure applied to the substrate by the scrubber brushes 115, 120. In contrast, the washer assembly 325 requires replacement at a frequency of greater than 20,000 substrates. As the scrubber brushes 115, 120 need to be replaced at about every 20,000 substrates, the replacement of the washer assembly 325 coincides with every other scrubber brush replacement cycle. Thus the replacement frequency of the washer assembly 325 provides a more consistent and coincidental replacement frequency than that of the conventional washer design.

While the foregoing is directed to embodiments of the invention, other and further embodiments of the invention may be devised without departing from the basic scope thereof.

What is claimed is:

1. A roller assembly adapted to support or rotate a substrate in a brush cleaning module, comprising:

a first washer; and a second washer, the first washer and the second washer having an annular groove formed at least partially in a surface of the first washer or the second washer, the annular groove including at least two substantially parallel opposing sidewalls adapted to contact the major surfaces of a substrate along a periphery of the substrate, each of the opposing sidewalls comprising a compressible material having a pre-compressed dimension that is less than a thickness of the periphery of the substrate, wherein the annular groove includes a bottom surface, the bottom surface being formed entirely by the second washer.

2. A roller assembly adapted to support or rotate a substrate in a brush cleaning module, comprising:

a first washer; and a second washer, the first washer and the second washer having an annular groove formed at least partially in a surface of the first washer or the second washer, the annular groove including at least two substantially parallel opposing sidewalls adapted to contact the major surfaces of a substrate along a periphery of the substrate, each of the opposing sidewalls comprising a compressible material having a pre-compressed dimension that is less than a thickness of the periphery of the substrate, wherein each of the at least two opposing sidewalls includes a textured surface.

3. The roller assembly of claim 2, wherein the textured surface includes a finish of about 2 microns Ra to about 4 microns Ra.

4. The roller assembly of claim 3, wherein the textured surface includes a grid pattern.

5. The roller assembly of claim 3, wherein the textured surface includes a pattern comprising one or more raised structures.

6. The roller assembly of claim 5, wherein the raised structures include one or more circular segments.

7. A roller assembly for supporting or rotating a substrate in a brush cleaning module, comprising:

a washer assembly sandwiched between a hub and a flange, the washer assembly comprising:

a first washer; and a second washer contacting a surface of the first washer, the first washer and second washer having sidewalls defining an annular groove adapted to receive a periphery of a substrate, the annular groove having a width that is less than a thickness of the periphery of the substrate, wherein the annular groove includes a bottom surface corresponding to the width of the annular groove, the bottom surface being formed entirely by the second washer.

8. The roller assembly of claim 7, wherein the sidewalls include a textured surface.

9. The roller assembly of claim 8, wherein the annular groove comprises a first sidewall and a second sidewall.

10. The roller assembly of claim 9, wherein the first sidewall or the second sidewall includes a textured surface.

11. The roller assembly of claim 9, wherein the first sidewall and the second sidewall includes a textured surface.

12. The roller assembly of claim 8, wherein the first sidewall and the second sidewall includes a surface roughness that is about 2 microns Ra to about 4 microns Ra.

* * * * *